United States Patent [19]

Webb

[11] 4,217,010

[45] Aug. 12, 1980

[54] ADJUSTABLE VOLUME-SPLIT REFRIGERATOR

[75] Inventor: William M. Webb, Louisville, Ky.

[73] Assignee: General Electric Company, Louisville, Ky.

[21] Appl. No.: 972,569

[22] Filed: Dec. 22, 1978

[51] Int. Cl.[2] ..... F25D 11/00

[52] U.S. Cl. ..... 312/214; 312/312; 62/265

[58] Field of Search ..... 312/214, 311, 312, 272, 312/273; 49/475, 481; 62/103, 187, 265, 99

[56] References Cited

U.S. PATENT DOCUMENTS

| | | | |
|---|---|---|---|
| 1,556,711 | 10/1925 | Pietrzycki | 312/312 |
| 2,713,776 | 7/1955 | Smith | 62/99 |
| 2,737,782 | 3/1956 | Antico | 62/103 |
| 2,933,783 | 4/1960 | Leto | 49/481 |
| 3,027,732 | 4/1962 | Mann et al. | 62/187 |
| 3,316,044 | 4/1967 | Carbary | 312/214 |
| 3,429,628 | 2/1969 | Laszlo | 312/214 |
| 3,726,578 | 4/1973 | Armstrong | 312/214 |
| 3,942,853 | 3/1976 | Grimm et al. | 312/214 |
| 3,982,801 | 9/1976 | Heidorn et al. | 312/312 |
| 4,120,550 | 10/1978 | Sherburn | 312/214 |

*Primary Examiner*—Victor N. Sakran

*Attorney, Agent, or Firm*—Frederick P. Weidner; Radford M. Reams

[57] ABSTRACT

The partition between fresh food and freezer compartments of, for example, a "top mount" refrigerator is movably mounted to vary the volume split between the two compartments. A lever actuated reciprocal drive mechanism is provided to translate the partition to its desired partition without the need to remove the partition or the food in the refrigerator to accomplish the change. The thermal break between the two compartments is maintained by an extensible section mounted between the movable partition and the fixed front mullion of the refrigerator.

11 Claims, 6 Drawing Figures

ADJUSTABLE VOLUME-SPLIT REFRIGERATOR

BACKGROUND OF THE INVENTION

This invention pertains to a refrigerator having a partition separating a fresh food compartment from a freezer compartment in which it is desired to be able to vary the volume ratio of the freezer and fresh food compartments. Typically this might be desirable when a special purchase of frozen food is made and it becomes necessary to expand temporarily the size of the freezer compartment to hold the increased volume load. Numerous arrangements exist in the prior art to accomplish this result.

One example of such prior art arrangement is illustrated in U.S. Pat. No. 3,027,732—L. J. Mann et al, wherein there is shown a top mount refrigerator with a removable partition that can be inserted at any of a variety of selected positions to increase or decrease the size of the freezer compartment. This arrangement necessitates the removal of the food from the freezer compartment in order to effect the transition. In addition, a single door is employed thus having the disadvantage that both compartments are exposed to ambient environment any time access to either one of the compartments is desired. U.S. Pat. No. 3,726,578—Armstrong illustrates a side-by-side refrigerator in which the vertical partition can be pivoted to vary the size of the freezer compartment. This arrangement, however, requires the use of sectional doors for selected access to the desired compartment and also requires the use of special mullion gaskets to maintain proper air seals independent of the compartment configuration. U.S. Pat. No. 2,713,766—Smith illustrates an embodiment in which a small freezer compartment within a refrigerator employs horizontally telescoping side walls to expand the freezer compartment size. U.S. Pat. No. 2,737,782—Antico is exemplary of a construction in which a removable partition is employed to provide a third section at an intermediate temperature, the partition being movable essentially as in Mann et al above to increase the effective size of freezer compartment.

There is not shown in this prior art and there is therefore a need for a convenient arrangement for varying the size of the freezer compartment of a modern refrigerator in which the freezer compartment occupies the full front to back space of the refrigerator and is separated from the fresh food compartment by a non-removable partition without requiring a special door and gasket construction and which size variation can be accomplished without the need to remove the contents of the freezer.

SUMMARY OF THE INVENTION

In accordance with the present invention, an improvement is provided in an adjustable volume split refrigerator of the type including fresh food and freezer compartments separated by a common partition, the front frame of the refrigerator having a fixed mullion aligned with the partition and separating the compartment openings along the adjacent edges of the doors. The improvement comprises, in part, the provision of partition movement means for providing reciprocal translation of the common partition to vary the volume ratio of the two compartments. The improvement of the invention further includes means flexibly coupling the partition to the fixed front mullion for maintaining the separation of the two compartments as the partition is moved.

DETAILED DESCRIPTION OF THE PREFERRED EMBODIMENT

Figure 1:
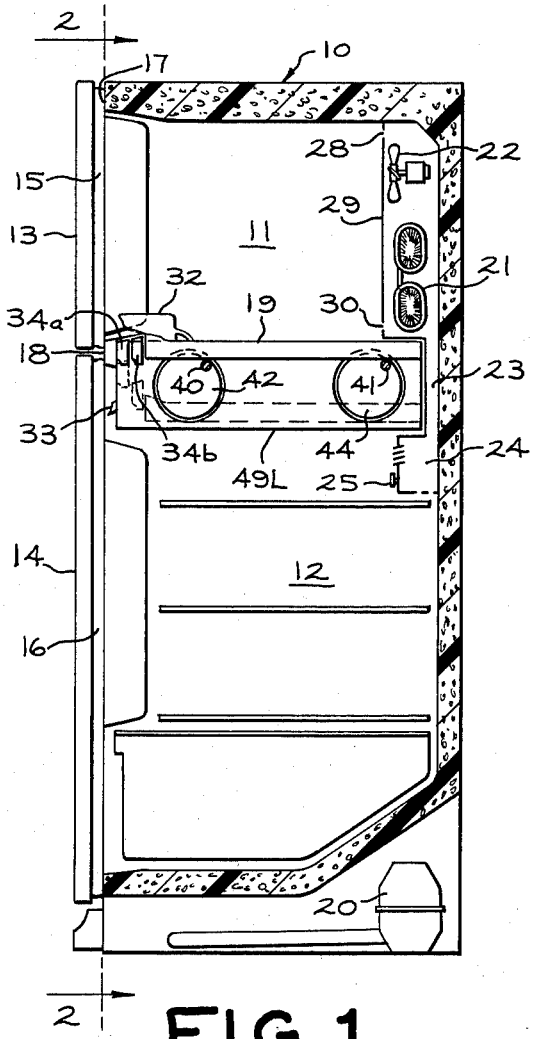
FIG. 1 is a side cross-sectional view of a top mount refrigerator for which the present invention is particularly well adapted.
Figure 2:
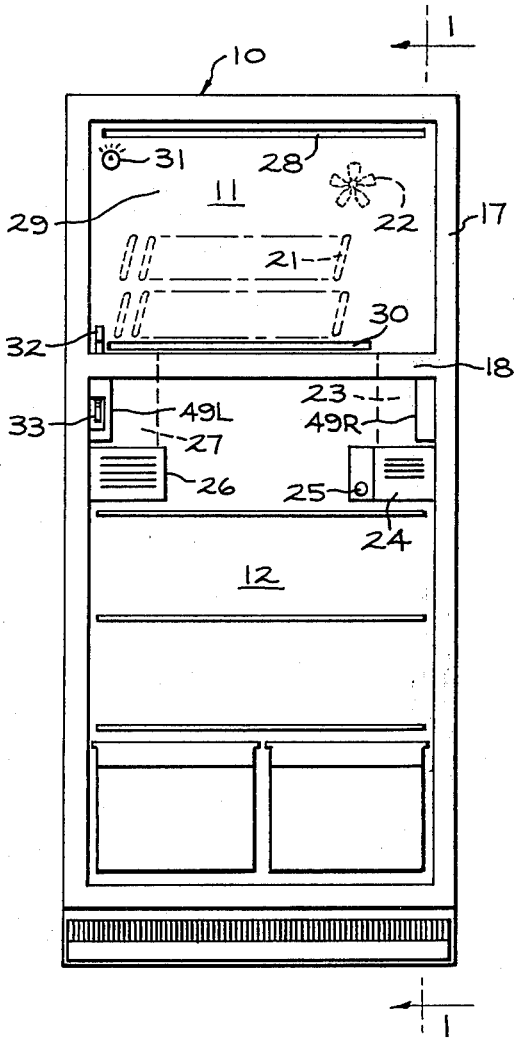
FIG. 2 is a frontal view of the refrigerator of FIG. 1.

Referring to FIGS. 1 and 2, there is shown a refrigerator 10 of the type conventionally referred to as a "top mount" refrigerator in which a freezer compartment 11 is located above a fresh food compartment 12. Each compartment is provided with a separate access door 13 and 14 mounted in vertical alignment on the front frame 17 of the refrigerator 10 so as to enable independent access to the desired compartment. Gaskets 15 and 16 are conventionally included on doors 13 and 14 to provide an air insulating seal around each door opening thus maintaining the desired temperatures in each compartment. Front frame 17 of refrigerator 10 defines the openings to compartments 11 and 12 and includes a fixed front mullion 18 separating the openings of the two compartments along the lower and upper edges respectively of doors 15 and 16. As is conventional practice mullion 18 is generally in alignment with a partition 19 which separates the freezer and fresh food compartments 11 and 12. As will be discussed in greater detail hereinafter, partition 19 is arranged to be movable in a reciprocal manner so as to vary the freezer to fresh food volume ratio in accordance with the present invention.

Refrigerant compressor 20 is connected via suitable hermetic connections (not shown) to an evaporator section 21 mounted in a plenum chamber at the rear of the freezer section 11. To provide cooling air for fresh food compartment 12, a fan 22 draws air from across evaporator 21 and forces it down duct 23 out through openings 24. Openings 24 are located below the lowermost position of movable partition 19. A conventional cold control 25 is mounted in the fresh food compartment to control the temperature therein. The cool air entering through openings 24 is circulated around the fresh food compartment and draw back in through air return grill 26 for passage back to the evaporator section plenum via duct 27. Fan 22 additionally forces air from across evaporator 21 out opening 28 across the top of the plenum front wall 29 and, after circulation through the freezer compartment 11, is drawn back into the evaporator through lower opening 30. Freezer temperature control 31 is provided to control the operation of the refrigerant system to maintain a desired temperature in the freezer compartment.

Figure 3:
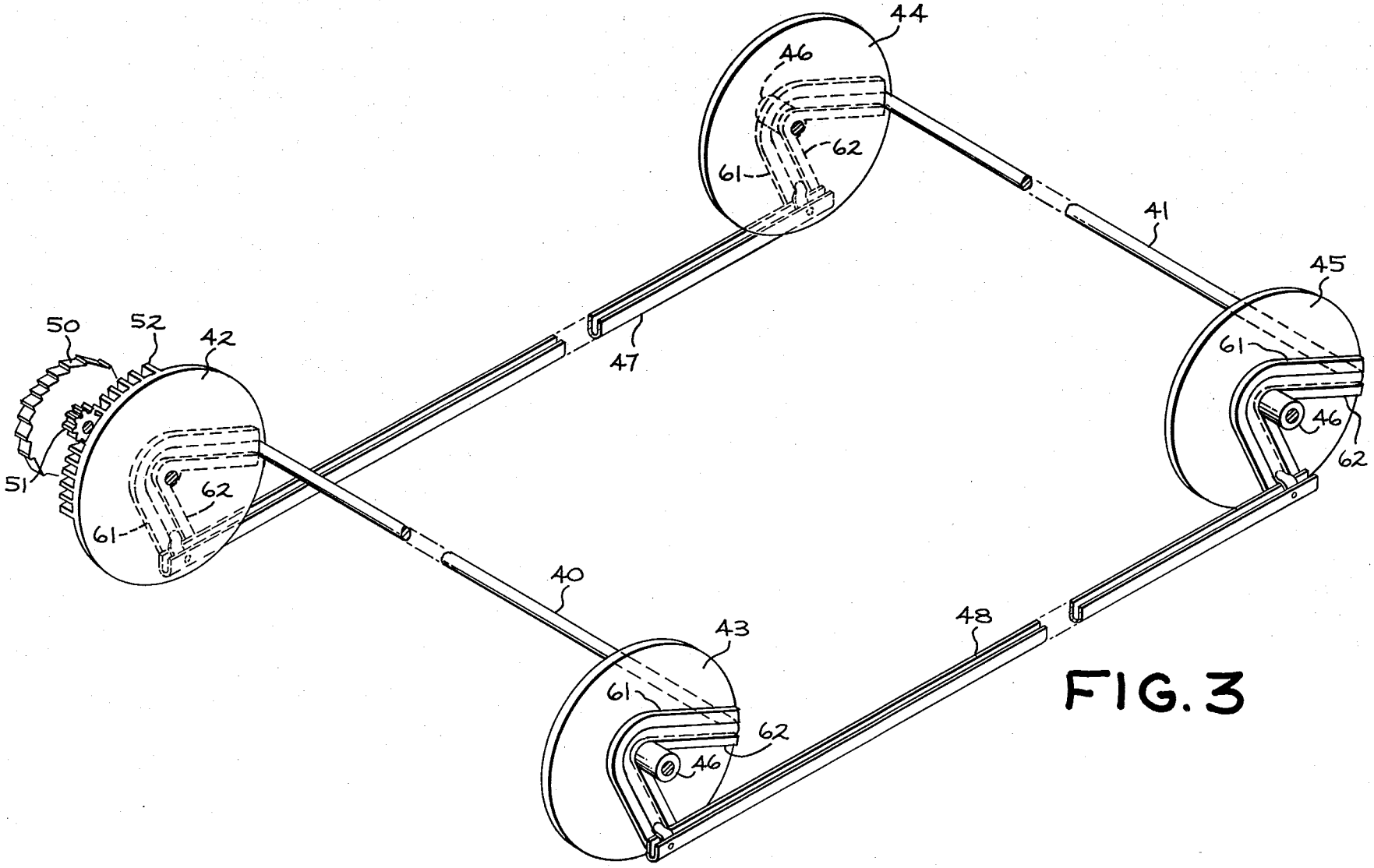
FIG. 3 is a perspective view of a partition support and movement mechanism useful in the refrigerator of FIG. 1.

In accordance with a principal feature of the invention, partition movement means, activated in the embodiment of FIG. 1 by lever handles 32 and 33, are included for providing reciprocal translation of partition 19 to vary the volume ratio of the freezer and fresh food compartments. Referring now to FIG. 3, this means includes a support structure comprising a pair of cross-rods 40, 41 extending between motion transmitting wheels 42, 43 and 44, 45 respectively. Wheels 42–45 are each pivotally mounted on the sidewalls of the refrigerator cabinet by pins 46 and are intercoupled by connecting push-rods 47 and 48 as shown in FIG. 3. Partition 19 rests on cross-rods 40 and 41. Rotation of wheel 42 will cause cross-rods 40 and 41 to rise and fall depending on the direction of rotation of wheel 42.

Figure 4:
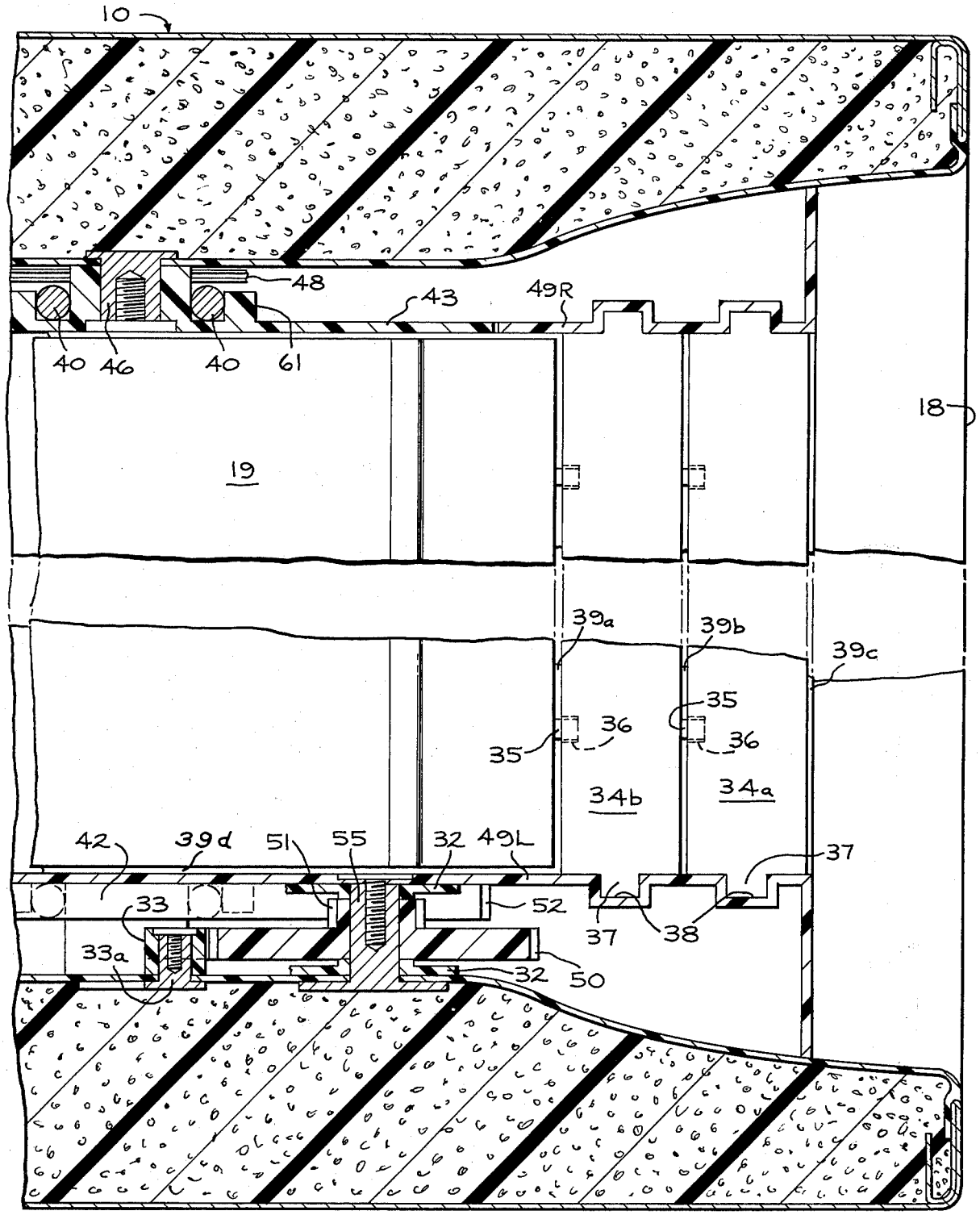
FIGS. 4–6 are detailed illustrations of the operating mechanisms employed in the embodiment of the invention illustrated in FIGS. 2 and 3.
Figure 5:
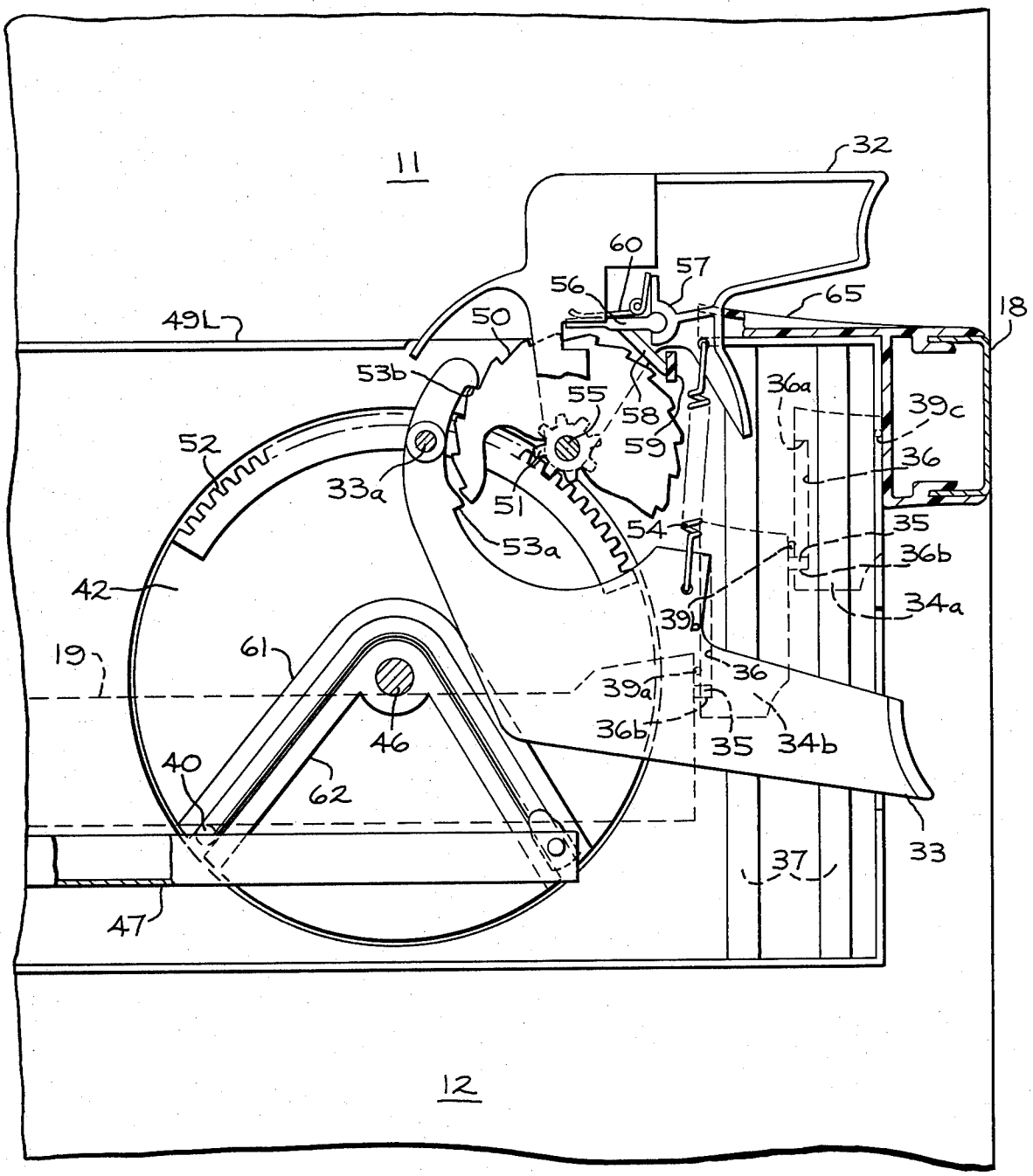

Referring again to FIG. 1, further in accordance with the principal aspect of the present invention, there is provided extensible means including transverse segments 34 coupling the partition 19 to the fixed front mullion 18 for maintaining the separation of the freezer and fresh food compartments 11, 12 as the partition 19 is moved to its desired position. As best seen in FIG. 4, two elongated segments **34*a* and 34*b* extend transversely of the refrigerator 10 with the frontmost segment 34*a* abutting fixed front frame mullion 18 in limited sliding engagement with the rearmost segment 34*b* abutting the frontal edge of partition 19 also in limited sliding engagement. Partition 19 and segments 34*a*, 34*b* are loosely interconnected by means of tabs 35 which project into mating slots 36, the latter slots being recessed in each of the segments and having upper and lower end portions 36*a* and 36*b*, respectively (FIG. 5). In addition, segments 34*a*, 34*b* are provided with guides 37 on the sides thereof which mate with slots 38 on the left side housing 49L to maintain the correct orientation of the segments 34*a*, 34*b* as they are raised and lowered in accordance with the invention. Insulating seals 39*a–c* are provided respectively between front mullion 18, segments 34*a* and 34*b*, and partition 19. A further insulating seal 39*d* is provided preferably between the remaining portion of the perimeter of partition 19** and the inner surfaces of the freezer compartment. These seals serve to maintain thermal separation between the freezer and fresh food compartments.

Figure 6:
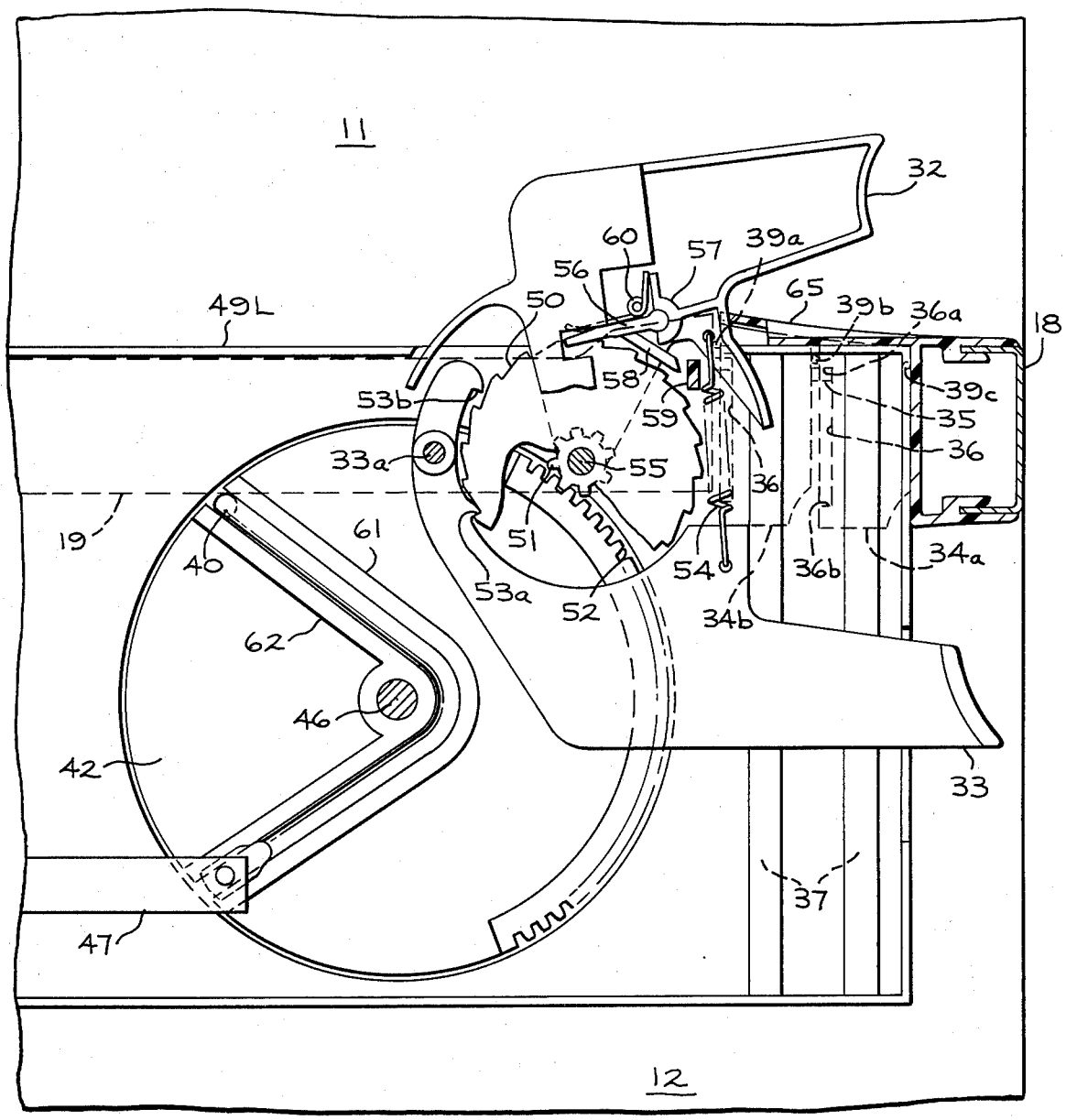

Referring now specifically to FIGS. 4–6, a suitable mechanism for raising and lowering partition 19 will be considered in detail. In particular, there is provided a bidirectional ratchet drive mechanism comprising a ratchet wheel 50 to which is affixed pinion gear 51, the teeth of which mate with the teeth of a bull gear 52 integrally formed on drive wheel 42. Lever handles 32 and 33 are provided to cause rotation of ratchet wheel 50 to raise or lower platform 19. In the case of the illustrated top mount refrigerator, up handle 32 is accessible only through freezer opening and down handle 33 through the fresh food opening thus facilitating visual observation of the compartment that is having its volume decreased by the movement of the partition.

In its resting position, the weight of partition 19 biases a tooth of the ratchet wheel 50 against the detent pawl **53*a* of the down lever handle 33 which is, in turn, biased about pivot pin 33*a* into position by the action of spring 54. Lowering of partition 19 is accomplished by pushing on handle 33 wich releases detent pawl 53*a* allowing ratchet wheel 50 to rotate incrementally until detent pawl 53*b* is engaged by a tooth of wheel 50. In this way, the partition 19** can be lowered to any desired position between its uppermost and lowermost positions.

Raising of partition 19 is accomplished by use of up handle 32 which is levered about the rotational axis 55 of wheel 50 and pinion gear 51. Handle 32 includes a drive pawl 56 pivoted at one end in a recessed shoulder 57 integrally molded into the handle 32. Pawl 56 has an arm 58 riding against the surface of stationary tab 59 the purpose of which is to hold drive pawl 56 out of engagement with the teeth of ratchet wheel 50 until handle 32 is pushed forward. At this time, a leaf spring 60 forces drive pawl 56 into engagement with the teeth of ratchet 50. This rotates the ratchet wheel and pinion gear in a counterclockwise direction and drive wheel 42 in a clockwise direction thus raising partition an incremental amount with each push on handle 32. The ratchet wheel 50 is prevented from counter-rotating by the engagement of detent pawl **53*a*** with the ratchet teeth.

As shown in the illustrated embodiment, push-rods 47 and 48 are generally in compression and for this reason are formed in U-shaped manner along their length for rigidity. Connecting rods 40 and 41 each extend through notches in the drive wheels 42–45 and bend around axles pins 46 to form bell crank levers. In order to avoid undue strees on the drive wheels, the bell crank lever portions of the connecting rods are nested within grooves formed by upstanding ridges 61, 62 molded on each wheel. The entire drive mechanism is enclosed at the sides by housings 49L and 49R. The axle pins 46 of the drive wheels may be mounted directly on the metal inner surfaces of the refrigerator as shown in FIG. 4. If the inner surface is plastic, it would be necessary to add further stiffening for the plastic as is well known in the art.

Segments **34*a* and 34*b* are, in effect, free floating within the confines of the surrounding structure. Tabs 35 do not perform any substantial support function, their purpose being primarily to cause the adjacent segment to move as the tabs encounter the end portions of slots 36. For this reason, it is desirable to provide an extension cover 65** over the segments to prevent the placing of any food packages directly on the segments.

While, in accordance with the patent statutes, there has been described what at present is considered to be the preferred embodiment of the invention, it will be obvious to those skilled in the art that various changes and modifications may be made therein without departing from the invention. For example, the segments 34 might be replaced with a plurality of plastic sheets on rollers mounted on partition 19 with their ends attached to mullion 18. Thus, as the partition is moved down, the sheets unroll and extend to maintain the thermal break between the freezer and fresh food compartments. Accordingly, it is intended by the appended claims to cover all such changes and modifications as fall within the true spirit and scope of the invention.

What is claimed is:

1. An improved adjustable volume split refrigerator of the type having fresh food and freezer compartments separated by a common partition, the front frame of the refrigerator having a fixed mullion aligned with common partition and separating the compartment openings, the improvement comprising:

(a) partition movement means for providing reciprocal translation of the common partition to vary the volume ratio of the two compartments; and (b) means extensibly coupling the partition to the fixed front mullion for maintaining the separation of the two compartments as the partition is moved.

2. The improvement of claim 1, wherein the freezer compartment is located above the fresh food compartment, and in which the common partition is the floor of the freezer compartment and translates vertically to expand and contract the usable volume of the freezer compartment without the necessity for removing the freezer contents.

3. The improvement of claim 1 or 2, in which a substantial portion of the perimeter of the common partition is in sliding relationship with the interior surfaces of the freezer compartment.

4. The improvement of claim 3 in which insulating sealing means is included on that portion of the perimeter of the common partition which is in sliding relationship to the interior surfaces of the freezer compartment.

5. The improvement of claim 1 in which the coupling means comprises a plurality of elongated, loosely interconnected segments extending transversely of the front frame, the frontmost segment abutting the front frame mullion in limited sliding engagement and the rearmost segment abutting the frontal edge of the common partition in limited sliding engagement.

6. The improvement of claim 5 in which the interconnected segments include sealing means between each segment and between the frontmost segment and the adjacent surface of the front frame mullion.

7. The improvement of claim 6 in which insulating sealing means are additionally included between a substantial portion of the perimeter of the common partition and the interior surfaces of the freezer compartment whereby thermal separation is substantially maintained between the fresh food and freezer compartments at all positions of the common partition.

8. The improvement of claim 5 in which the common partition is translatable to extended planar positions which are beyond the space immediately behind the front frame mullion, and in which the segments are interconnected in sliding overlapping manner to permit said extended translation of the partition while maintaining the thermal integrity of the two compartments.

9. The refrigerator of claim 1 or 5 in which the means for moving the partition includes a ratchet mechanism having a pair of manually operated levers each lever extending respectively into and accessible only from the compartment toward which the partition is to be moved.

10. The refrigerator of claim 2 in which the coupling means comprises a plurality of elongated, loosely interconnected, slidably overlapping segments and in which a ledge extends back from the front frame mullion to cover the segments.

11. The refrigerator of claim 10 in which the means for moving the freezer floor includes a pair of manually operated handles, the handle adapted to raise the freezer floor being accessible only from the freezer compartment and the handle adapted to lower the freezer floor being accessible only from the fresh food compartment.

* * * * *